US009126307B2

(12) United States Patent
Roth et al.

(10) Patent No.: US 9,126,307 B2
(45) Date of Patent: Sep. 8, 2015

(54) IMPACT BAFFLE FOR CONTROLLING HIGH-PRESSURE FLUID JETS AND METHODS OF CUTTING WITH FLUID JETS

(71) Applicant: ALSTOM Technology Ltd, Baden (CH)

(72) Inventors: Philipp Roth, Baden (CH); Walter Maurer, Oftringen (CH); Vera de Vries, Daettwil (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 139 days.

(21) Appl. No.: 13/744,520

(22) Filed: Jan. 18, 2013

(65) Prior Publication Data

US 2013/0189902 A1 Jul. 25, 2013

(30) Foreign Application Priority Data

Jan. 20, 2012 (EP) ..... 12151934

(51) Int. Cl.

| | |
|---|---|
| ***B24C 9/00*** | (2006.01) |
| ***B24C 1/04*** | (2006.01) |
| *B26D 5/00* | (2006.01) |
| *B26F 3/00* | (2006.01) |

(52) U.S. Cl.

CPC ..... *B24C 1/045* (2013.01); *B26F 3/008* (2013.01); *B26D 5/00* (2013.01); *B26F 3/004* (2013.01)

(58) Field of Classification Search

CPC ..... B24C 1/04; B24C 1/045; B24C 3/18; B24C 9/00

USPC ..... 451/2, 39, 40, 75, 87, 88; 83/53, 177, 83/72

See application file for complete search history.

(56) References Cited

U.S. PATENT DOCUMENTS

| | | | | |
|---|---|---|---|---|
| 4,651,476 | A * | 3/1987 | Marx et al. | 451/40 |
| 4,669,229 | A | 6/1987 | Ehlbeck | |
| 4,733,503 | A * | 3/1988 | Gallant et al. | 451/75 |
| 4,827,679 | A * | 5/1989 | Earle, III | 451/40 |
| 4,848,042 | A * | 7/1989 | Smith et al. | 451/78 |
| 4,920,841 | A * | 5/1990 | Johnson | 83/177 |
| 5,097,731 | A * | 3/1992 | Vives et al. | 83/53 |
| 5,980,372 | A | 11/1999 | Spishak | |
| 7,628,678 | B2 * | 12/2009 | Moser et al. | 451/11 |
| 8,235,772 | B2 * | 8/2012 | Moser et al. | 451/199 |
| 2005/0050706 | A1 * | 3/2005 | Motzno | 29/426.5 |
| 2009/0178526 | A1 * | 7/2009 | Roth et al. | 83/72 |

FOREIGN PATENT DOCUMENTS

| | | | |
|---|---|---|---|
| CN | 86 1 04189 | A | 1/1987 |
| EP | 0244966 | A2 | 11/1987 |
| EP | 0252657 | A2 | 1/1988 |

OTHER PUBLICATIONS

European Patent Office, Extended European Search Report in European Patent Application No. 12151934 (Sep. 14, 2012).

First Office Action issued Nov. 3, 2014 by the Chinese Patent Office in corresponding Chinese Patent Application No. 2013100208221, and an English translation thereof.

* cited by examiner

*Primary Examiner* — Robert Rose

(74) *Attorney, Agent, or Firm* — Buchanan Ingersoll & Rooney PC

(57) ABSTRACT

An impact baffle for a jet cutting tool and a method to operate the baffle in conjunction with the jet cutting tool are described, the baffle with an impact layer and an laterally extended sensing layer to trigger a control signal for interrupting a cutting operation of the jet cutting tool after the impact layer is pierced by the jet cutting tool.

15 Claims, 4 Drawing Sheets

IMPACT BAFFLE FOR CONTROLLING HIGH-PRESSURE FLUID JETS AND METHODS OF CUTTING WITH FLUID JETS

CROSS-REFERENCE TO RELATED APPLICATION

Priority is claimed to European Patent Application No. EP 12151934.2, filed on Jan. 20, 2012, the entire disclosure of which is incorporated by reference herein.

FIELD

The present invention refers to the field of machining of workpieces using abrasive fluid jets. It specifically relates to an impact baffle for the high-pressure fluid jets of a fluid jet cutting tool and methods of cutting through a workpiece.

BACKGROUND

It has been known to use a fluid jet, typically a water jet, discharged at high pressure from a nozzle, for the machining, especially the cutting, of work pieces. The jet diameter is typically in the order of around 1 mm. In the case of so-called "abrasive water-jet cutting" (AWJ), water pressures of more than 300 MPa are used to generate a water jet with abrasive particles. Such a water jet can be used as an omni-directional cutting tool for cutting wide range of metallic and non-metallic materials with thicknesses of up to 200 mm.

In large turbines, particularly steam turbines, blades can be for example attached to the rotor by means of a pinned blade root where press-fitted or interference-fitted pins are placed in boreholes extending through the blade root and the rotor. Prior to their placement in the boreholes, the pins are for example cooled to low temperatures, e.g. by means of liquid nitrogen. Thus slightly reduced in size, they are then pressed into the borehole with heavy-duty tools, which results in a tight, high-tension fit between the pin and the turbine rotor and blade root.

During turbine maintenance, the turbine blading must be removed and replaced requiring the removal of the press-fit pins from their boreholes. However, this is a difficult procedure as the space between the blade rows can be confined, in some cases to dimensions as narrow as 15 mm (in case of industrial steam turbines)

The co-owned U.S. Pat. No. 7,628,678 describes the in-situ use of a water jet tool having a nozzle that is arranged at an angle with respect to a main body of the water jet tool. The water jet is directed over a portion of the surface of the pin and removes that portion thereby fragmenting the pin. In order to minimise damage to the surrounding material, the portions removed touches the interface between the pin and the surrounding solid material at a minimal number of points and over a minimal extent of the interface.

Compact collecting devices for water jets have already been proposed, which can be moved together with the water jet tool and can also be used in the case of confined space conditions at the application site. Such devices are described for example in the published European patent applications nos. EP 0244966 A2 and EP 0252657 A2 and the co-owned published United States patent application no. US 2009/0178526 A1, incorporated herein by reference for general aspects of using and controlling an impact baffle. The '526 application shows a collecting device for detecting the first impact of the high pressure water jet upon the collecting device, and using a corresponding signal for controlling the use of the water-jet tool, or detecting a malfunction of the collecting device and using a corresponding signal is used for terminating the use of the water-jet tool.

In view of the known prior art, it is seen as an object of the invention to improve the known collecting device, particularly for very confined spaces.

SUMMARY

An aspect of the invention provides an impact baffle configured to operate in conjunction with a jet cutting tool, the baffle comprising a sandwich structure including an impact layer and a laterally extended sensing layer, wherein the sandwich structure is configured to trigger a control signal for interrupting a cutting operation of the jet cutting tool after the impact layer is pierced by the jet cutting.

BRIEF DESCRIPTION OF THE DRAWINGS

Exemplary embodiments of the invention will now be described, with reference to the accompanying drawings, in which.

DETAILED DESCRIPTION

Figure 1:
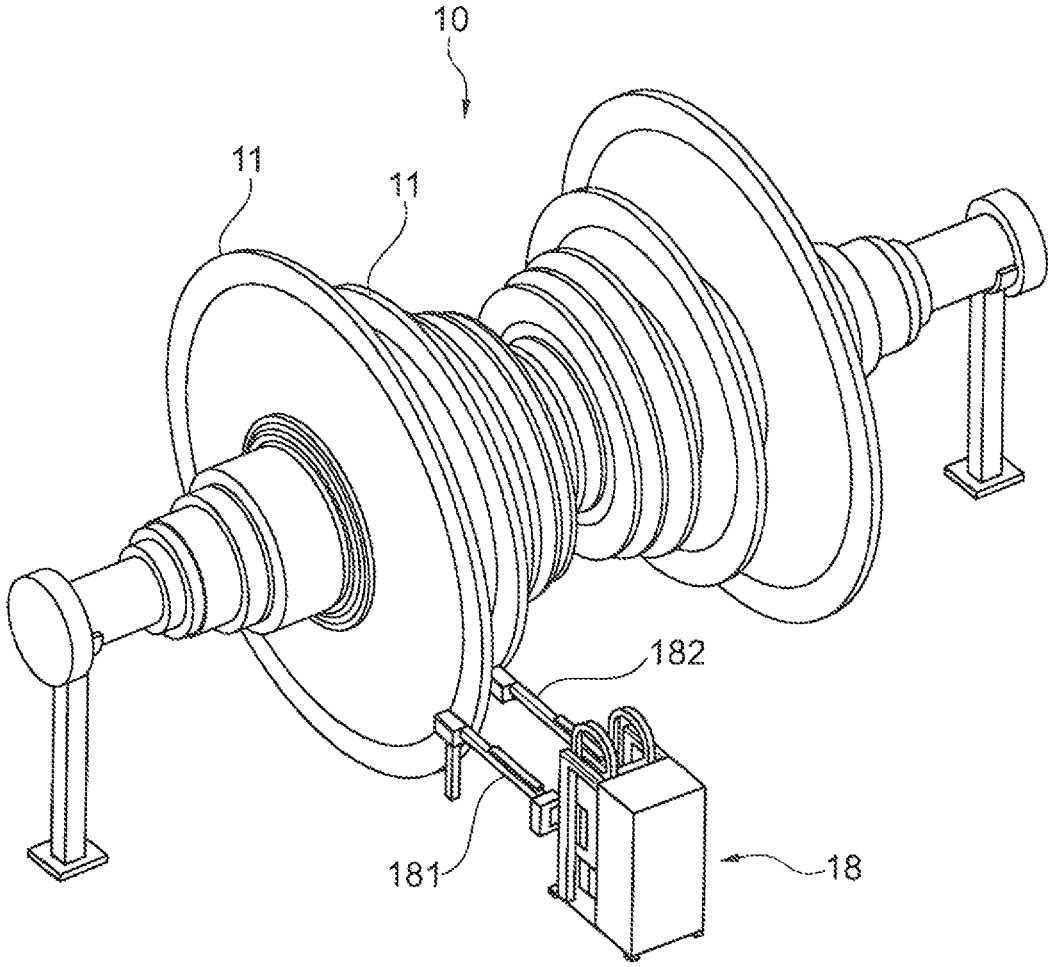
FIG. 1 shows a jet cutting tool with an impact baffle applied to the cutting of pins in turbine rotor.

In a preferred embodiment of this aspect of the invention, the extended sensing layer triggers the signal when being at least partly penetrated. In a variant of this embodiment the extended sensing layer includes a fine mesh or grid of conductive layers.

The impact baffle can further include a sensor registering the onset of an impact of the jet on the baffle, for example an accelerometer.

The impact baffle can further include a sensor for a detecting a proper mounting and/or proximity sensor for registering whether the baffle is in the correct position facing the work piece.

It is another preferred feature of impact baffle to have a width as measured in direction of the impacting jet of less than 20 mm or less than 15 mm, preferably 5 mm to 15 mm, and even more preferably 5 mm to 10 mm, to enable the baffle to fit for example within very confined gaps to access work pieces to be cut.

According to another aspect of the invention there is provided a method of using thin impact baffles exposed to a fluid jet, the method including the steps of generating an extended pre-cut through the work piece to be cut while avoiding piercing followed by the step of piercing through the extended pre-cut to create the cut through the workpiece.

In a preferred embodiment of the method, the extended cut has two end zones at which the cutting speed is reduced compared to the cutting speed when cutting the cut outside the end zones.

In a variant of this embodiment the cutting without piercing starts at a central position of the exposed face of the workpiece and is directed into a first direction towards the perimeter of the exposed face of the workpiece at a first cutting speed and when reaching a predetermined distance from the perimeter cutting without piercing is continued at a second reduced cutting speed until the perimeter is reached, then the direction of cutting is reverted and cutting with piercing within the existing pre-cut is started until the central position is reached and cutting without piercing restarts at the central position and is directed into a second direction towards the perimeter of the exposed face of the workpiece at the first cutting speed and when reaching the predetermined distance from the perimeter cutting without piercing is continued at the second reduced cutting speed until the perimeter is reached, then the direction of cutting is reverted and cutting with piercing within the existing pre-cut is started until the central position is reached again.

The first and second directions can be arbitrary chosen to split the workspace but are probably best along the same diameter line. It is also possible to alter the sequence of the steps such that the end zones are cut after the zone between the end zones is cut and pierced. The steps can be repeated to generate more than one cut through the workpiece. In particular, it is possible to cut two cuts into bolts, screws, pins or other fastening devices in a cross pattern to split them into four parts.

With this method the impact baffle is exposed to the high pressure fluid jet for a time period which is more than ten times shorter compared to known methods. The exposure time of the impact baffle to the fluid jet of the jet cutting tool can be reduced to 1 minute or less during the cutting of a standard turbine pin.

Aspects and details of examples of the present invention are described in further details in the following description using the example of the removal of pins holding blades in a steam turbine rotor.

Referring to FIG. 1 a turbine rotor 10 is shown having several turbine wheels 11 along its length. The turbine wheels 11 carry a circumferential row of blades. In a typical refitting operation it is the task to separate the blades, which are detachably fastened on the turbine wheels 11 of the rotor 10, from the rotor 10 by cutting the bolts or pins which are interference-fitted in corresponding holes in the rotor structure. The pins fix the blade roots within annular grooves of the turbine wheel 11. A water-jet tool 18 cuts the pins in the longitudinal direction. The pins are then removed from their holes using for example threads cut into their remaining parts. The turbine rotor of FIG. 1 is shown mounted onto columns of a workshop floor. However, the same operation can be performed in-situ with the cutting tool placed onto the platform of a power station.

The water-jet tool 18 has two parallel oriented arms 181, 182. The arms can be moved using hydraulics or electromagnetic motors. One arm carries the jet cutting tool and the other arm the impact baffle such that cutter and baffle are aligned across a gap when mounted in the correct position. To cut a pin, the tool 18 is moved to position the rotor wheel inside the gap. Then water loaded with abrasive material is supplied to an angled nozzle head via a high-pressure water feed line. Once a pin in the rotor wheel is cut through, the high-pressure water jet discharges on the other side of the turbine wheel 11 into the space between rotor wheels and can cause damage, if it is not blocked and rendered harmless after the breakthrough by a jet catching device such as the impact baffle of the present invention.

Figure 2A:
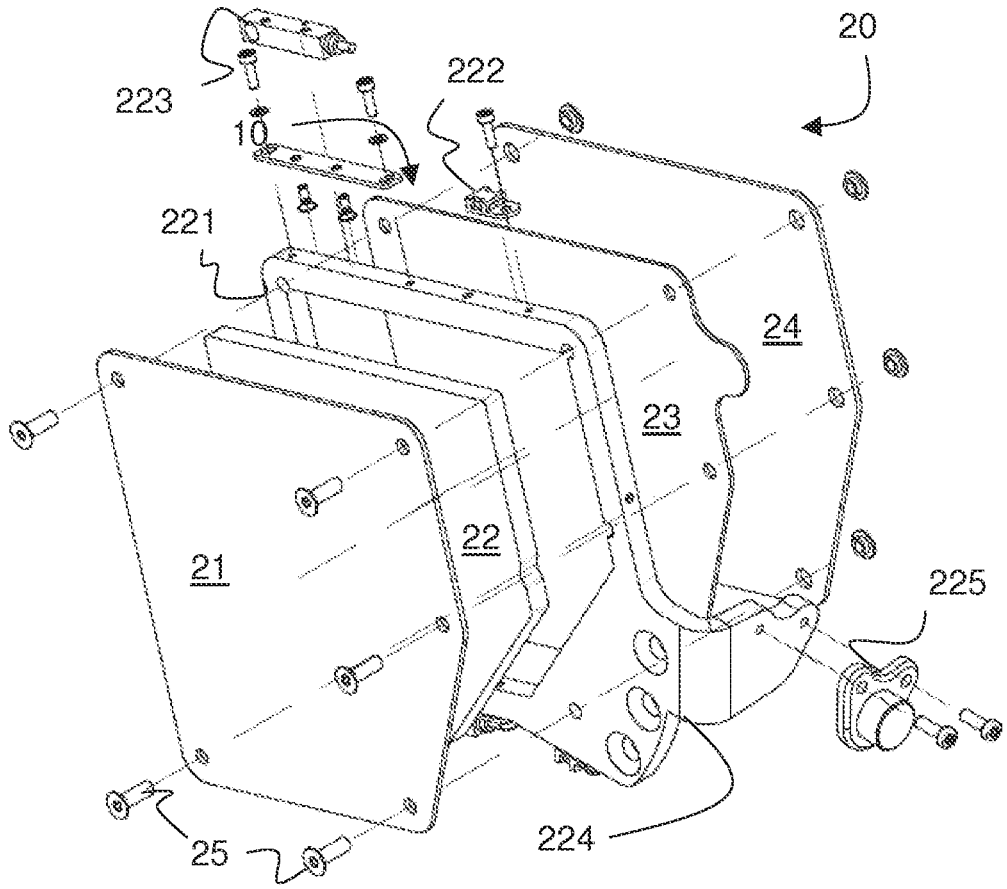
FIG. 2A is a schematic exploded view of a impact baffle in accordance with a example of the present invention.
Figure 2B:
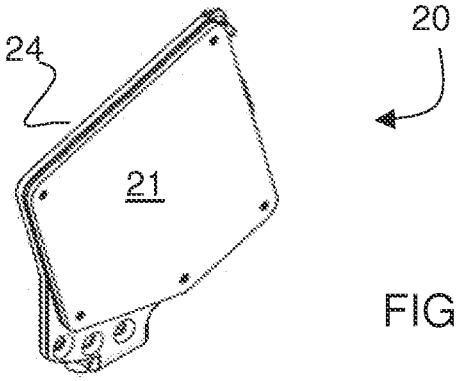
FIG. 2B shows the impact baffle of FIG. 2B in an assembled state.

In FIG. 2A, an impact baffle 20 for a high-pressure water jet according to an exemplary embodiment of the invention is reproduced as an exploded view. This impact baffle 20 is particularly suitable for applications involving in-situ machining turbine rotors 10 as described above and components of power plants, in which the space for collecting the water from the jet tool 18 is limited. The external dimensions of the exemplary impact baffle 20 are approximately 50 mm to 100 mm in lateral direction and 5 mm to 15 mm, preferably 5 mm to 10 mm, in depth so that it can be introduced into the narrow gap between adjacent turbine wheels. The width of the gap can be as small as 15 mm in some types of turbines, for example the distance between the first and second wheel in a industrial steam turbine.

The impact baffle 20 of FIG. 3 includes a sandwiched structure with several layers 21, 22, 23, 24 held together by several screws 25. Following the direction of the jet there is a first protective layer 21 made of a thin layer of a soft material such as structural foam, which provides a cover and a fastening for the impact plate 22. The impact plate 22 is surrounded by a steel frame structure 221 which allows for an easy replacement of the impact plate 22. The impact plate 22 is made of a very hard material such as tungsten carbide, as it is used to stop the water jet during normal operation. Both the first protective layer 21 and the impact plate 22 can be considered sacrificial layers as damage and degradation of these layers are envisaged during the normal operation of the impact baffle 20.

The thickness of the impact plate 22 contributes significantly to the overall depth of the impact baffle and should be made as thin as possible while at the same time preventing a piercing. In the current example the thickness of the impact plate 22 is chosen to be around 5 mm. Depending on the application, the thickness of the impact plate 22 can be chosen to be between 1 mm and 10 mm or even between 1 mm and 5 mm.

As is known from the co-owned published United States patent application no. US 2009/0178526 A1, an acceleration sensor 222 can be used to register the impact of the water jet on the impact plate 22 indicating a piercing or breakthrough of the jet through the workpiece. Based on a signal from the acceleration sensor 222, the cutting tool can then be moved to the next step of the cutting operation.

The frame structure provides further support for a proximity switch 223 based on induction which is used to monitor the proximity to the workpiece. The frame includes an extension 224 for mounting the impact baffle onto the arm 182 of the cutting tool 18 as shown in FIG. 1. A contact switch 225 is used to ensure that the baffle is safely mounted.

Also fixed to the frame is an extended sensing layer 23, which is used to monitor the break-through of the jet through the impact plate 22. In the present example the sensing layer 23 is essentially a printed circuit board with a pattern of conductive paths. If a path is interrupted, an emergency stop of the water jet is triggered. This emergency stop is designed to secure the fastest possible stop of the jet, bypassing or overriding all other pre-programmed operations of the tool.

It is worth noting that this stop is an emergency operation normally reserved only for the specific event of a piercing of the impact plate 22. As already mentioned above, it is the impact plate 22 which acts as the stop for the water jet during normal operations and the signals from the acceleration sensor 222 are used to control normal cutting operations.

The back of the impact baffle 20 is a security plate 24, which is again made of very hard material to stop the water jet after it pierced through both, impact plate 22 and sensing layer 23.

For the purpose of sending signals triggered or generated by impact baffle 20, all sensors mounted on the impact baffle 20 are connected to a signal processing device delivers corresponding control signals to the control unit (not shown in the figures) of the jet cutting tool 18. The impact baffle 20 thus becomes part of the control system of the water-jet tool.

The impact baffle 20 and its parts are simply and inexpensively constructed and represent easily exchangeable wear-resistant components. At least part of its components including the first protective layer 21 and the impact plate 22, itself, are designed to be degraded and damaged already during normal operations.

Impact baffles of the type described above with very thin jet impact or jet absorption layers are best used with an altered cutting method, which takes into consideration their limitations. A method of cutting a workpiece while avoiding early degradation of a thin impact baffle, for example the impact baffle above, is described schematically in the following making reference particularly to FIG. 3.

Figure 3A:
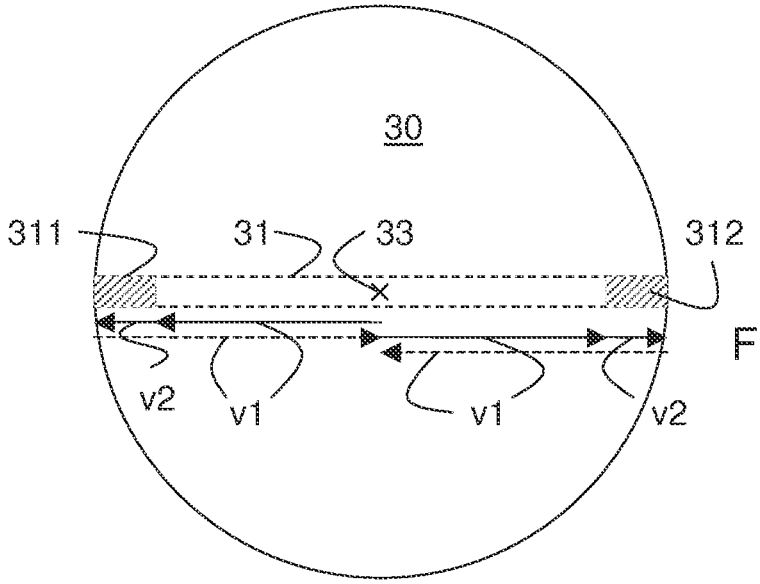
FIGS. 3A-3C illustrate variants of a cutting process to avoid long exposure times of the impact baffle to the cutting jet.

In FIG. 3A there is shown a pin 30 fixing a turbine blade to the turbine rotor as the workpiece to be cut. The planned cut 31 is a horizontal cut across the full diameter of the bolt marked by dashed lines. It includes two end zones 311, 312 located between the central zone of the cut and the circumference of the bolt 30. Arrows in the drawing indicate the cutting scheme or operation. An arrow denoted with v1 indicates a cutting path with a first cutting speed or feed rate v1. An arrow denoted with v2 indicates a cutting path with a first cutting speed or feed rate v2. The cutting speed v1 applied during the cutting of the central zone is faster than the cutting speed v2 applied during the cutting of the two end zones 311, 312.

The cutting operation seeks to control the cutting such that the workpiece there is first a pre-cut cut into the workpiece avoiding piercing through completely. And the workpiece is only pierced on a return path across a previously cut zone or pre-cut. The return path within the existing pre-cut is indicated by the dashed arrows in FIG. 3A. The required control parameters can be gained from knowledge about the material to be cut, the rate of penetration through such a material and the jet parameters or by conducting preliminary experiments using the same material and jet parameters. Even though the high-pressure fluid is blocked from exiting the cut through an opening on the opposite side for much longer than in known methods, the accuracy of the cut is sufficiently precise for the purpose of cutting bolts and similar cutting operations.

Figure 3B:
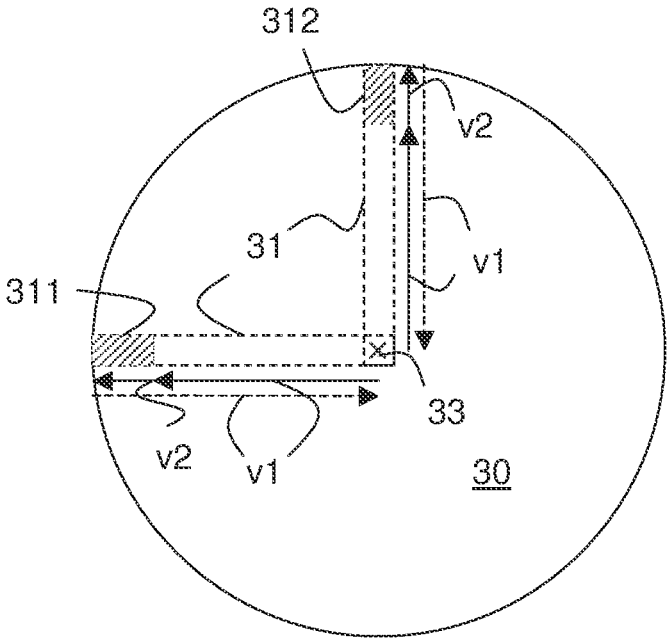
Figure 3C:
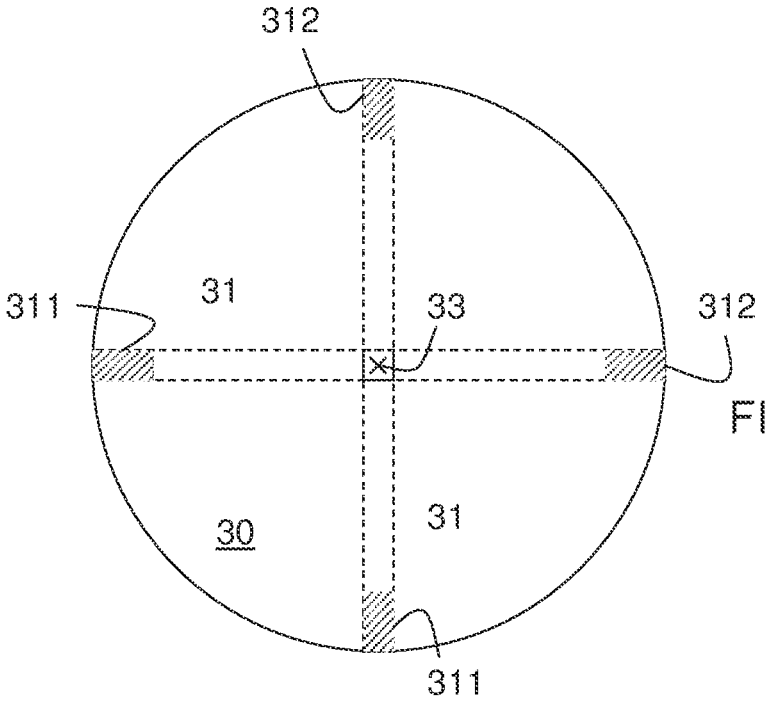

The FIGS. 3B and 3C illustrate how the above steps can be applied to generate cuts across the workpiece in arbitrary directions and how the can be applied twice or multiple times to generate several cuts through a common point or central position 33 to split the workpiece into a corresponding number of parts, for example to facilitate the removal of interference-fitted pins.

The present invention has been described above purely by way of example, and modifications can be made within the scope of the invention, such as specific dimensions or selection of materials. In particular the sensors described can alternatively be based on different principles. For example the integrity of the sensing layer can be monitored using the reflection or refraction pattern of optical and acoustic waves guided through it.

Each feature disclosed in the specification, including the drawings, may be replaced by alternative features serving the same, equivalent or similar purposes, unless expressly stated otherwise.

Unless explicitly stated herein, any discussion of the art throughout the specification is not an admission that such art is widely known or forms part of the common general knowledge in the field.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the attached claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise

LIST OF REFERENCE SIGNS AND NUMERALS turbine rotor 10
turbine wheel 11, 11'
water-jet tool 18
arms 181, 182
impact baffle 20
first protective layer 21
impact plate 22
frame structure 221
acceleration sensor 222
proximity switch 223
extension 224
contact switch 225
extended sensing layer 23
security plate 24
bolt 30
cut 31
end zones 311, 312
common point or central position 33
cutting speeds v1, v2

The invention claimed is:

1. An impact baffle configured to operate in conjunction with a jet cutting tool, the baffle comprising:

a sandwich structure including an impact layer, a security plate, and a laterally extended sensing layer between the impact layer and the security plate, wherein the sensing layer is configured to trigger a control signal for interrupting a cutting operation of the jet cutting tool after the impact layer is pierced by the jet cutting.

2. The impact baffle of claim 1, wherein the extended sensing layer is configured to trigger the control signal when being damaged.

3. The impact baffle of claim 2, wherein the extended sensing layer includes a mesh of conductive pathways configured to trigger the control signal when cut.

4. The impact baffle of claim 1, comprising:

a sensor, wherein the sensor is configured to register an onset of an impact of a jet on the baffle.

5. The impact baffle of claim 1, comprising:

a sensor, wherein the sensor is configured to register an onset of an impact of a jet on the baffle for normal control of operation of the jet cutting tool and the extended sensing layer to trigger an immediate interruption of the jet.

6. The impact baffle of claim 1, having a width of less than 20 mm, measured in a direction of an impacting jet.

7. The impact baffle of claim 1, having a width of 5 mm to 15 mm, measured in a direction of an impacting jet.

8. The impact baffle of claim 1, wherein the impact layer has a width of 1 mm to 7 mm, measured in direction of an impacting jet.

9. The impact baffle of claim 1, comprising:

a first protective layer comprising a softer material than the impact layer; and arranged to be exposed to a jet before the impact layer.

10. A method of operating a jet cutting tool in conjunction with an impact baffle, the baffle configured to catch or absorb a fluid jet of the jet cutting tool, the method comprising:

placing the impact baffle with reduced thickness for catching or absorbing a fluid jet into a projected path of the fluid jet;

generating an extended pre-cut through a workpiece to be cut with the fluid jet, while avoiding piercing the workpiece;

subsequently, piercing through the workpiece within and along the extended pre-cut with the fluid jet; and wherein the generating, while avoiding piercing, comprises:

initiating a cut at a central position of an exposed face of a workpiece;

directing the cut into a first direction towards a perimeter of the exposed face of the workpiece, at a first cutting speed; after reaching a predetermined distance from the perimeter, continuing cutting, while avoiding piercing, the workpiece at a second cutting speed until the perimeter is reached, creating a first section of the extended pre-cut; then, reverting the direction of cutting and cutting with piercing within the first section of the extended pre-cut until a central position is reached;

restarting cutting, while avoiding piercing, from the central position directed in a second direction, towards the perimeter of the exposed face of the workpiece, at the first cutting speed; and after reaching the predetermined distance from the perimeter, continuing cutting, while avoiding piercing, at the second cutting speed, until the perimeter is reached, creating a second section of the extended pre-cut; and reverting a direction of cutting and cutting with piercing within the existing second section of the pre-cut until the central position is reached again, wherein the first cutting speed is greater than the second cutting speed, and wherein the first and second directions are along the same diameter line.

11. The method of claim 10, wherein the workpiece to be cut is a fastening device.

12. The method of claim 10, wherein the workpiece to be cut is a bolt.

13. The method of claim 10, wherein the workpiece to be cut is a screw.

14. The method of claim 10, wherein the workpiece to be cut is a pin.

15. The method of claim 10, wherein the workpiece to be cut is a pin configured to fix a turbine blade to another part of the turbine.

* * * * *